US006503120B1

(12) United States Patent
Lumpkins

(10) Patent No.: US 6,503,120 B1
(45) Date of Patent: Jan. 7, 2003

(54) BASKETBALL RETRIEVAL DEVICE

(76) Inventor: Keith Lumpkins, 109 Norman Rd., Newark, NJ (US) 07106

( * ) Notice: Subject to any disclaimer, the term of this patent is extended or adjusted under 35 U.S.C. 154(b) by 0 days.

(21) Appl. No.: 09/876,968

(22) Filed: Jun. 8, 2001

(51) Int. Cl.[7] ..... A63H 33/26
(52) U.S. Cl. ..... 446/129; 446/437; 446/454
(58) Field of Search ..... 446/129–139, 446/431, 437, 457, 454, 456, 465, 76, 236, 396; 273/239, 141 A; 473/570, 450

(56) References Cited

U.S. PATENT DOCUMENTS 3,953,935 A * 5/1976 Reiner et al. ..... 439/37
4,529,389 A * 7/1985 Kennedy et al. ..... 446/26
4,571,199 A * 2/1986 Murakami ..... 446/135
4,684,354 A * 8/1987 Orenstein ..... 446/130
4,726,800 A 2/1988 Kobayashi
4,822,044 A * 4/1989 Perkitny ..... 273/109
4,917,644 A * 4/1990 Sunshine ..... 273/456
4,927,401 A 5/1990 Sonesson
5,439,408 A 8/1995 Wilkinson
5,566,949 A * 10/1996 Gorden ..... 273/348.3
5,578,999 A 11/1996 Matsuzawa et al.
5,692,946 A 12/1997 Ku
D393,030 S 3/1998 Mills
6,171,169 B1 * 1/2001 Saunders ..... 446/137

* cited by examiner

*Primary Examiner*—Derris H. Banks
*Assistant Examiner*—Faye Francis

(57) ABSTRACT

A basketball retrieval device for allowing the user to retrieve the basketball without the using having to run after the ball. The basketball retrieval device includes an attractor unit being adapted to be worn about a user's wrist; and also includes a retrievable system being adapted to be disposed in the basketball and being attractable to the retriever unit.

6 Claims, 1 Drawing Sheet

BASKETBALL RETRIEVAL DEVICE

BACKGROUND OF THE INVENTION

1. Field of the Invention

The present invention relates to a basketball moving system and more particularly pertains to a new basketball retrieval device for allowing the user to retrieve the basketball without the using having to run after the ball.

2. Description of the Prior Art

The use of a basketball moving system is known in the prior art. More specifically, a basketball moving system heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,439,408; 5,692,946; 4,726,800; 4,927,401; 5,578,999; and U.S. Pat. No. Des. 393,030.

While these devices fulfill their respective, particular objectives and requirements, the aforementioned patents do not disclose a new basketball retrieval device. The inventive device includes an attractor unit being adapted to be worn about a user's wrist; and also includes a retrievable system being adapted to be disposed in the basketball and being attractable to the retriever unit.

In these respects, the basketball retrieval device according to the present invention substantially departs from the conventional concepts and designs of the prior art, and in so doing provides an apparatus primarily developed for the purpose of allowing the user to retrieve the basketball without the using having to run after the ball.

SUMMARY OF THE INVENTION

In view of the foregoing disadvantages inherent in the known types of basketball moving system now present in the prior art, the present invention provides a new basketball retrieval device construction wherein the same can be utilized for allowing the user to retrieve the basketball without the using having to run after the ball.

The general purpose of the present invention, which will be described subsequently in greater detail, is to provide a new basketball retrieval device which has many of the advantages of the basketball moving system mentioned heretofore and many novel features that result in a new basketball retrieval device which is not anticipated, rendered obvious, suggested, or even implied by any of the prior art basketball moving system, either alone or in any combination thereof.

To attain this, the present invention generally comprises an attractor unit being adapted to be worn about a user's wrist; and also includes a retrievable system being adapted to be disposed in the basketball and being attractable to the retriever unit.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new basketball retrieval device which has many of the advantages of the basketball moving system mentioned heretofore and many novel features that result in a new basketball retrieval device which is not anticipated, rendered obvious, suggested, or even implied by any of the prior art basketball moving system, either alone or in any combination thereof.

It is another object of the present invention to provide a new basketball retrieval device which may be easily and efficiently manufactured and marketed.

It is a further object of the present invention to provide a new basketball retrieval device which is of a durable and reliable construction.

An even further object of the present invention is to provide a new basketball retrieval device which is susceptible of a low cost of manufacture with regard to both materials and labor, and which accordingly is then susceptible of low prices of sale to the consuming public, thereby making such basketball retrieval device economically available to the buying public.

Still yet another object of the present invention is to provide a new basketball retrieval device which provides in the apparatuses and methods of the prior art some of the advantages thereof, while simultaneously overcoming some of the disadvantages normally associated therewith.

Still another object of the present invention is to provide a new basketball retrieval device for allowing the user to retrieve the basketball without the using having to run after the ball.

Yet another object of the present invention is to provide a new basketball retrieval device which includes an attractor unit being adapted to be worn about a user's wrist; and also includes a retrievable system being adapted to be disposed in the basketball and being attractable to the retriever unit.

Still yet another object of the present invention is to provide a new basketball retrieval device that is easy and convenient to use.

Even still another object of the present invention is to provide a new basketball retrieval device that would prevent the basketball from getting away from the user and possibly damaging the property of others.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
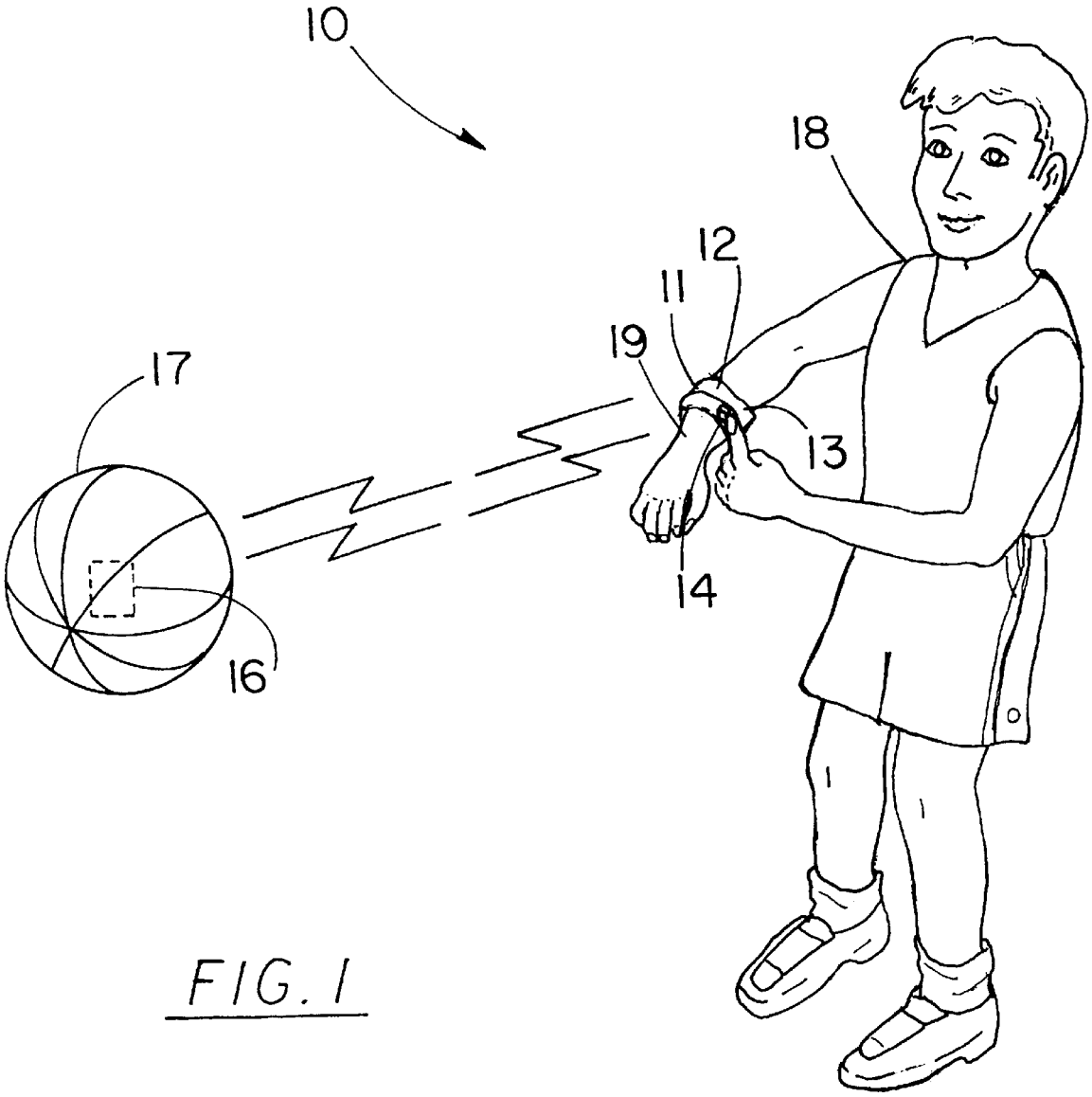
FIG. 1 is a perspective view of a new basketball retrieval device according to the present invention.

With reference now to the drawings, and in particular to FIG. 1 thereof, a new basketball retrieval device embodying the principles and concepts of the present invention and generally designated by the reference numeral 10 will be described.

As best illustrated in FIG. 1, the basketball retrieval device 10 generally comprises an attractor unit being adapted to be worn about a user's wrist 19. The attractor unit includes a wristband 11, and also includes a magnet 12 being conventionally disposed in the wristband 11, and further includes a power supply 13 such as a battery back being conventionally disposed in the wristband 11, and also includes an on/off switch 14 being conventionally disposed upon the wristband 11 and being conventionally connected to the power supply 13 for energizing the magnet 11. The on/off switch 14 is depressibly and conventionally disposed upon the wristband 11 for energizing the magnet 12.

A retrievable system is adapted to be disposed in the basketball 17 and is attractable to the retriever unit. The retrievable system includes magnet-attracting material 16 being adapted to be conventionally disposed in and throughout the basketball 17 with the magnet-attracting material 16 including metallic material.

In use, the user 18 places the wristband 11 about one's wrist 19 and while playing and shooting the basketball 17, the user 18 presses the on/off switch 14 to deactivate the magnet 12. However, after having shot the basketball 17, the user 18 can press the on/off switch 14 to activate the magnet 12 to create a strong magnetic force field about the wristband 11 which is strong enough to attract the metallic material 16 in the basketball 17 thus causing the basketball 17 to roll and move to the wristband 11 so that the user can control and retrieve the basketball 17.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A basketball retrieval device comprising:

an attractor unit being adapted to be worn about a user's wrist;

a basketball having an interior;

a retrievable system disposed in said basketball and being attractable to said retriever unit; and said attractor unit including a wristband, said wristband having an electromagnet being: mounted therein;

a power supply being positioned in said wristband; and wherein said wristband includes an on/off switch being disposed upon said wristband and being electrically coupled to said power supply for selectively energizing said electromagnet.

2. A basketball retrieval device as described in claim 1, wherein said on/off switch is depressibly disposed upon said wristband for selectively energizing said electromagnet.

3. A basketball retrieval device as described in claim 1, wherein said retrievable system includes magnet-attracting material being mounted in said interior of said basketball.

4. A basketball retrieval device as described in claim 3, wherein said magnet-attracting material comprises a highly magnetic metallic material.

5. A basketball retrieval device comprising:

an attractor unit being adapted to be worn about a user's wrist, said attractor unit including a wristband, said wristband having an electromagnet being mounted therein;

a power supply being positioned in said wristband;

wherein said wristband includes an on/off switch being disposed upon said wristband and being electrically coupled to said power supply for energizing said electromagnet, said on/off switch being depressibly disposed upon said wristband for selectively energizing said electromagnet;

a basketball having an interior; and a retrievable system being adapted to be disposed in said basketball and being attractable to said retriever unit, said retrievable system including magnet-attracting material being mounted in said interior of said basketball, said magnet-attracting material comprising a substantially highly magnetic metallic material.

6. A basketball retrieval device comprising:

an attractor unit being adapted to be worn about a user's wrist;

a basketball having an interior;

a retrievable system disposed in said basketball and being attractable to said retriever unit; and said attractor unit including a wristband, said wristband having an electromagnet being mounted therein.

* * * * *